US009035573B2

(12) United States Patent
Suzuki et al.

(10) Patent No.: US 9,035,573 B2
(45) Date of Patent: May 19, 2015

(54) POWER SUPPLY DEVICE

(75) Inventors: Shinichi Suzuki, Kitasaku-gun (JP); Kazuaki Saito, Kitasaku-gun (JP)

(73) Assignee: MINEBEA CO., LTD., Kitasaku-Gun (JP)

( * ) Notice: Subject to any disclaimer, the term of this patent is extended or adjusted under 35 U.S.C. 154(b) by 72 days.

(21) Appl. No.: 13/584,676

(22) Filed: Aug. 13, 2012

(65) Prior Publication Data

US 2013/0099699 A1 Apr. 25, 2013

Related U.S. Application Data

(60) Provisional application No. 61/550,897, filed on Oct. 24, 2011.

(51) Int. Cl.
*H05B 37/02* (2006.01)
*H05B 33/08* (2006.01)

(52) U.S. Cl.
CPC ..... *H05B 37/0254* (2013.01); *H05B 33/0815* (2013.01); *H05B 33/0845* (2013.01)

(58) Field of Classification Search
CPC ..... H05B 37/02; G06F 1/26; F21V 33/00
USPC ..... 315/307, 247, 302; 362/217.02, 217.14, 362/362, 85, 375
See application file for complete search history.

(56) References Cited

U.S. PATENT DOCUMENTS

| | | | | |
|---|---|---|---|---|
| 7,832,645 | B2 * | 11/2010 | Chen et al. | 235/492 |
| 8,282,012 | B2 * | 10/2012 | Chen et al. | 235/492 |
| 2006/0175983 | A1 * | 8/2006 | Crouse et al. | 315/291 |
| 2006/0214603 | A1 * | 9/2006 | Oh et al. | 315/246 |
| 2009/0079367 | A1 * | 3/2009 | Crouse et al. | 315/307 |

OTHER PUBLICATIONS

Texas Instrument User's Guide, "AN-1840 USB I2C Interface Board Reference Manual", Apr. 2008—Revised Apr. 2013, pp. 1-7.*

* cited by examiner

*Primary Examiner* — Daniel D Chang
(74) *Attorney, Agent, or Firm* — Masuvalley & Partners

(57) ABSTRACT

A power supply device containing a first board, a second board, an enclosure into which the first board and the second board are installed, a power supply unit which supplies power to an external load, a control circuit unit for controlling output current and/or output voltage from the power supply unit to the external load, the control circuit unit being embedded on the first board, a memory which stores control information, the memory being utilized in the control circuit unit for controlling the output current and/or the output voltage from the power supply unit, and an interface unit which is capable of receiving the control information from an external device and transmitting the control information to the memory, the interface unit being embedded on the second board which is physically separated from the first board.

12 Claims, 9 Drawing Sheets

POWER SUPPLY DEVICE

This application claims benefit of prior-filed provisional App. No. 61/550,897 entitled "Power-Supply Apparatus" filed on Oct. 24, 2011 in the name of Shinichi Suzuki, said provisional application being hereby incorporated by reference as if fully set forth herein.

FIELD OF THE INVENTION

The field of the present invention relates to power supply devices for supplying power to loads such as LED modules as lighting devices. In particular, described herein is an apparatus and a method for enabling the change of control parameters of the power supply device to optimize the output voltage and/or current to the load such as LED modules from an external device, corresponding to the changes of the specifications of LED modules, such as, power consumptions, input voltage of the LED modules.

BACKGROUND

The product specifications of LED modules are specified by, for example, optical qualities such as visible output colors, number of LEDs, intensity or brightness, and electrical characteristics such as voltage range and current. There are various kinds of LED modules in a marketplace.

For this reason, as for the power supply device for driving this LED module, it is necessary to have functions for changing and optimizing controlling parameters of the power supply device corresponding to the specifications of LED modules to be used. Setting up of these control parameters is performed before shipment of the power supply devices and/or after the power supply devices have been shipped from the manufacturing places of the power supply devices.

WO2009/133723 discloses a power supply device for supplying electric power to a load, for example, an LED module, which is capable of changing internal control parameters corresponding to the changes of specifications of load, etc., from an external device without changing hardware configurations when changes are necessary. This design change is enabled by writing control parameters (control information) corresponding to the changes of specifications of the LED module from an external device into a control parameter recording device of the power supply device.

The following problems occur when transmitting the control parameters from the external device to the power supply device. In a switching power supply device disclosed in WO2009/133723, it seems that the method of transmitting the control parameter from the external device to the switching power supply device is performed by data communication via physical contact or transmission lines between the output terminals of the data writer and a data input terminal of the switching power supply device. However, there is no specific description pertaining to the data communication between the data writer and the power supply device. Further, it is anticipated that the cost of communication method will be an expensive depending on the configuration of the data communication method.

Further, as an alternative method of transmitting control parameters, non-contact data communication method, such as, wireless data communications, such as WiFi, ZigBee, etc. may be possible. However, the system configurations of these non-contact or wireless data communication system requires relatively large system configuration in general. Accordingly, it has been difficult to realize a simple and less expensive configuration of a non-contact data communication of the power supply device. Further it is necessary to obtain a permit or license from a specific organization to use the wireless system depending on the emission power and frequencies to be used.

SUMMARY OF THE INVENTION

It is therefore an object of the present invention to overcome the above drawback. An object of the present invention will be attained by a power supply device containing a first board, a second board, an enclosure into which the first board and the second board are installed, a power supply unit which supplies power to an external load, a control circuit unit for controlling output current and/or output voltage from the power supply unit to the external load, the control circuit unit being embedded on the first board, a memory which stores control information, the memory being utilized in the control circuit unit for controlling the output current and/or the output voltage from the power supply unit, and an interface unit which is capable of receiving the control information from an external device and transmitting the control information to the memory, the interface unit being embedded on the second board which is physically separated from the first board.

In one embodiment of the present invention described above, the second board onto which the interface unit is embedded is physically separated from the first board onto which the control circuit unit is embedded. In this embodiment, the interface unit has a function for relaying the control information from the external device to the memory in the control circuit. As described above, by embedding the interface unit on a dedicated board (the second board) which is physically separated from the first board on which the other circuits, such as the control circuit are embedded, it becomes possible to increase the freedom to select the location of the interface unit in the product design process and realize an interface unit to easily receive the control information from outside while the configuration of the interface unit is simple and inexpensive because the interface unit becomes a simple configuration and dedicated to an interface function.

Another aspect of the present invention is an LED lighting system containing an LED, a power supply device for supplying power to the LED, the power supply device containing a power supply unit for supplying power to the LED, a control unit for controlling the power to the LED by using control information stored in a memory installed in the control unit, a main board containing the power supply unit and the control unit, an interface board for receiving the control information generated by an external computer and transmitting the control information to the memory, the interface board being positioned differently from a position of the main board.

According to an embodiment described above, by providing the interface board being positioned differently from a position of the main board to which the power supply unit and the control unit are installed, the size of the interface board can be configured in a relatively compact shape. Accordingly, it becomes possible to expand the degree of freedom for selecting the position of the interface board inside the power supply device in the LED lighting system, which is another advantage of the embodiment.

Another aspect of the present invention is a method for writing data in a power supply device for supplying power to an external load, containing the steps of removing a sealing material from an enclosure of the power supply device, inserting a probe pin of a writer into an opening of the enclosure, inputting a control parameter into a microcontroller in the power supply device, and attaching the sealing material onto the enclosure of the power supply device.

According to an embodiment of the present invention described above, by removing the sealing material from the opening provided on the enclosure just before using the probe pin of the writer of the control information to be sent to the power supply unit, and the sealing material is put back over the opening, the degree of airtightness is kept high while utilizing the power supply device so that reliability against dust in the environment where the power supply device is used becomes high.

Other objects, features and advantages of the present invention will be described from following disclosure including drawings.

DETAILED DESCRIPTION OF THE INVENTION

Figure 1:
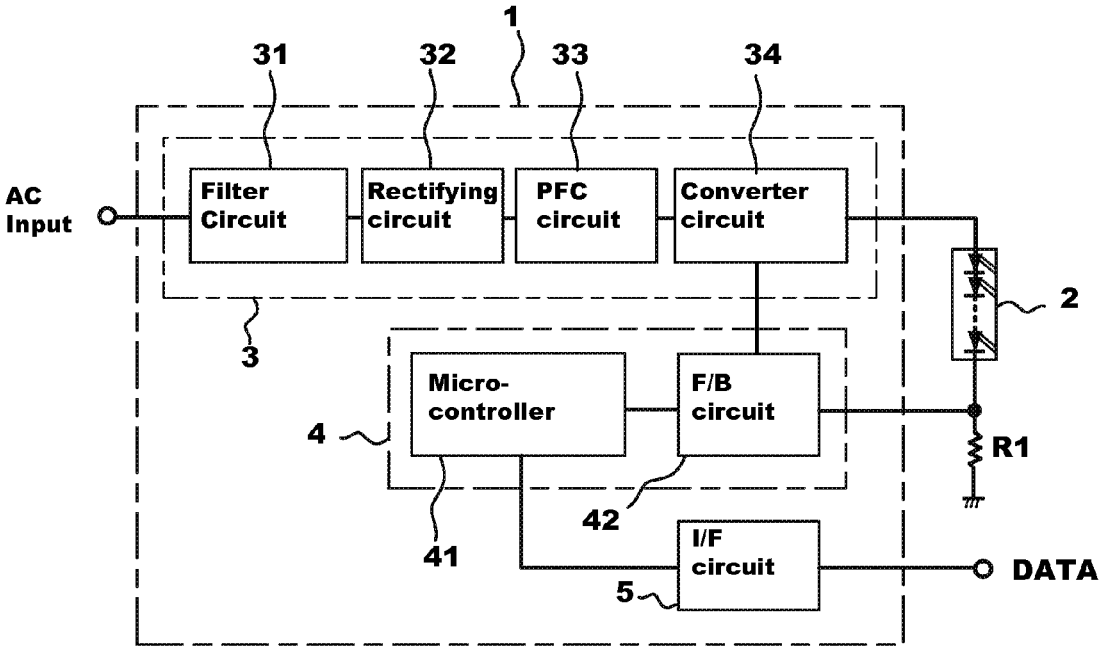
FIG. 1 illustrates a system configuration of the power supply device of the present invention containing a power supply unit, a control circuit unit and an I/F unit, which supply power to an LED module.

Referring to the drawings, the following describes the details of the power supply device being an embodiment of the present invention. The scope of the present invention is not limited to those drawings.

FIG. 1 illustrates a block diagram which illustrates the basic circuit configuration of a power supply device 1. As illustrated in FIG. 1, the power supply device 1 is comprised of a power supply unit 3, a control circuit unit 4 and an I/F circuit 5. The power supply unit 3 converts inputted alternating-current voltage to direct-current voltage and supplies power to an LED module 2 as a load of the power supply device 1. The control circuit unit 4 controls the operation of the power supply unit 3 and optimizes the output current and/or the output voltage according to the specifications of the LED module 2. The I/F circuit 5 has functions for communicating (sending and/or receiving) control parameters (control information) between an outside device and the power supply device 1.

The power supply unit 3 is embedded on a main board 3*a*. The power supply unit 3 is comprised of a filter circuit 31 which filters the alternate-current voltage from an AC (alternate-current) power source, a rectification circuit 32, which rectifies the alternating-current voltage, a PFC (Power Factor Correction) circuit 33 for improving a power factor and a converter circuit 34 for converting the rectified voltage into direct-current voltage.

The control circuit unit 4 contains control circuit embedded on a daughter board 4*a*. The control circuit unit 4 is mounted on the main board 3*a*. The control circuit unit 4 is comprised of the control circuit containing a microcontroller 41 (one example of a memory) which stores a control program and a control parameter, and F/B (feedback) circuit 42 into which current detection voltage is inputted from a detection resistor R1 which detects the current flowing into an LED module 2 by detecting the voltage generated between terminals of the detection resistor R1.

The I/F circuit 5 does not have electronic components embedded thereon. A copper pattern is formed on the surface of the I/F circuit 5 (one example of an interface board) which is physically separated from the main board 3*a* or the daughter board 4*a*.

Figure 2:
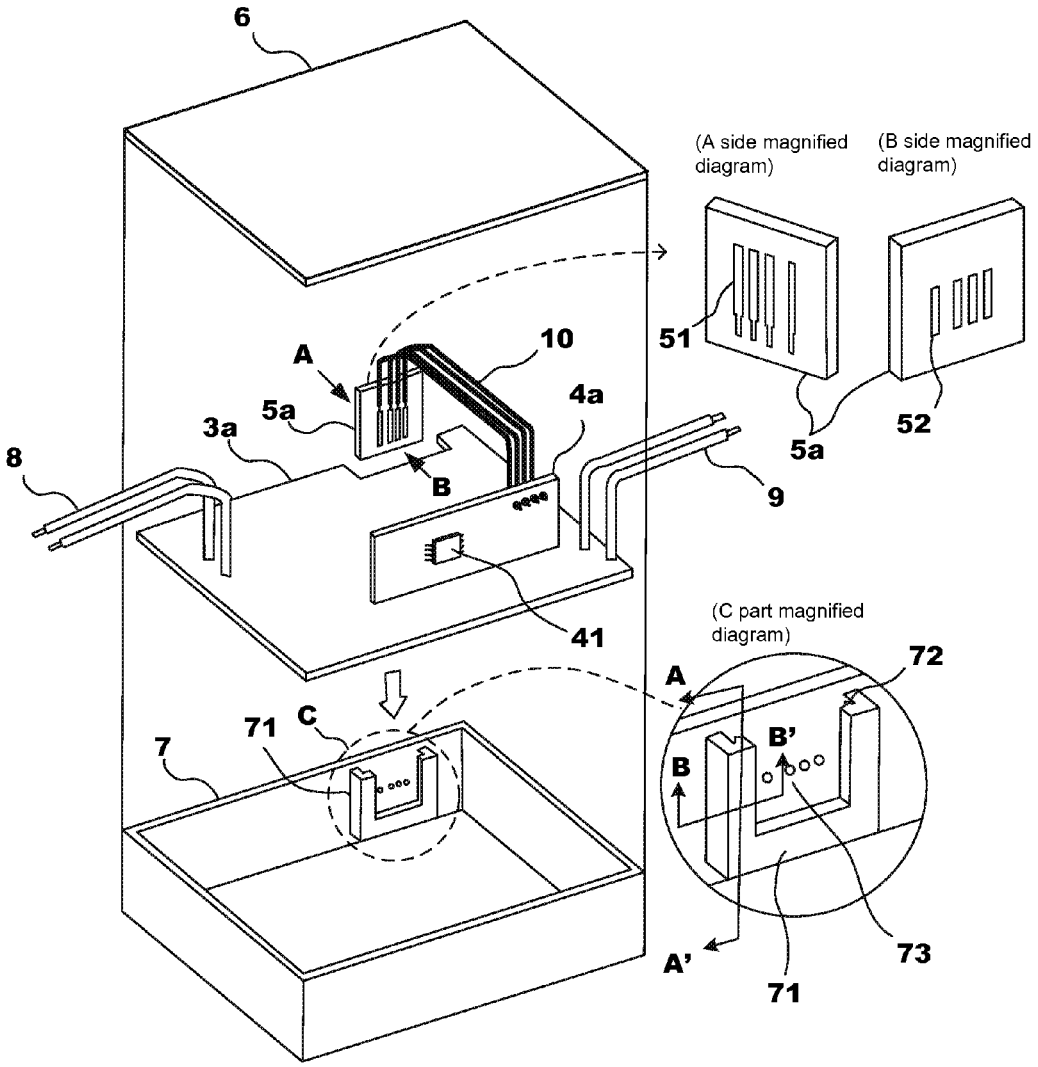
FIG. 2 illustrates an exploded perspective view illustrating the hardware configuration of the power supply device illustrated in FIG. 1. The power supply device is configured by a power supply unit, a control circuit unit and an I/F circuit unit. The power supply device supplies electric power to the LED module and the control parameters are transmitted from outside of the power supply device.

FIG. 2 illustrates an exploded perspective view showing the hardware configuration of the power supply device 1.

On the main board 3*a*, electronic components which configure the power supply unit 3 are embedded although they are not illustrated in FIG. 2. The control circuit is embedded on the daughter board 4*a*. The control circuit unit 4 containing the daughter board 4*a* is installed on the main board 3*a* (lead pins mounted on the daughter board 4*a* are inserted into through holes formed on the main board 3*a* and soldered).

Further, on the main board 3*a*, input cords 8 to input alternate-current voltage to the power supply unit 3 and output cords 9 to output output-voltage from the power supply unit 3 to the LED module 2 are mounted (soldered). The output cords 9 also have a function for feeding back the voltage which is converted the detected current flowing through the above-mentioned LED module 2 to the F/B circuit 42.

The I/F board 5*a* electrically communicates to the daughter board 4*a* via a plurality of wires (lead wires) 10 (four wires in FIG. 2). A plurality of connecting pads 52 (four pads in FIG. 2) are formed on B surface of the I/F board 5*a*, on which core wires of one end of wires 10 are soldered (refer to the B surface magnified figure). Core wires of the other end of wires 10 are inserted into through-holes formed at the daughter board 4*a* and soldered respectively. A plurality of electrode pads 51 (four in FIG. 2) are formed on A surface of the I/F board 5*a* (A surface enlarged figure). The electrode pads 51 on the A surface and the connecting pads 52 on the B surface are electrically connected through the through-holes.

In this embodiment, one end of wires 10 is soldered onto B surface of the I/F board 5*a*. Soldering is recommended particularly when the power supply device 1 is used under severe environmental conditions. However, when the environment where the power supply device 1 is utilized is not so severe environmental conditions, connection of wires 10 to the I/F board 5*a* may be made by utilizing wire connectors instead of soldering.

In this case, cost up due to the rise of material cost of the connectors will be anticipated and the countermeasure to the wraparound and invasion of the filler into the connector are needed. In other words, the material cost of the connector and the labor cost for soldering wires may involve the trade-off in selecting the connection method. Labor cost of soldering wires onto the connection pads increase the labor cost but can obtain reliable connection. However, when using connectors instead of soldering wires, the labor cost may be reduced but the material cost for the connectors may increase.

Figure 3:
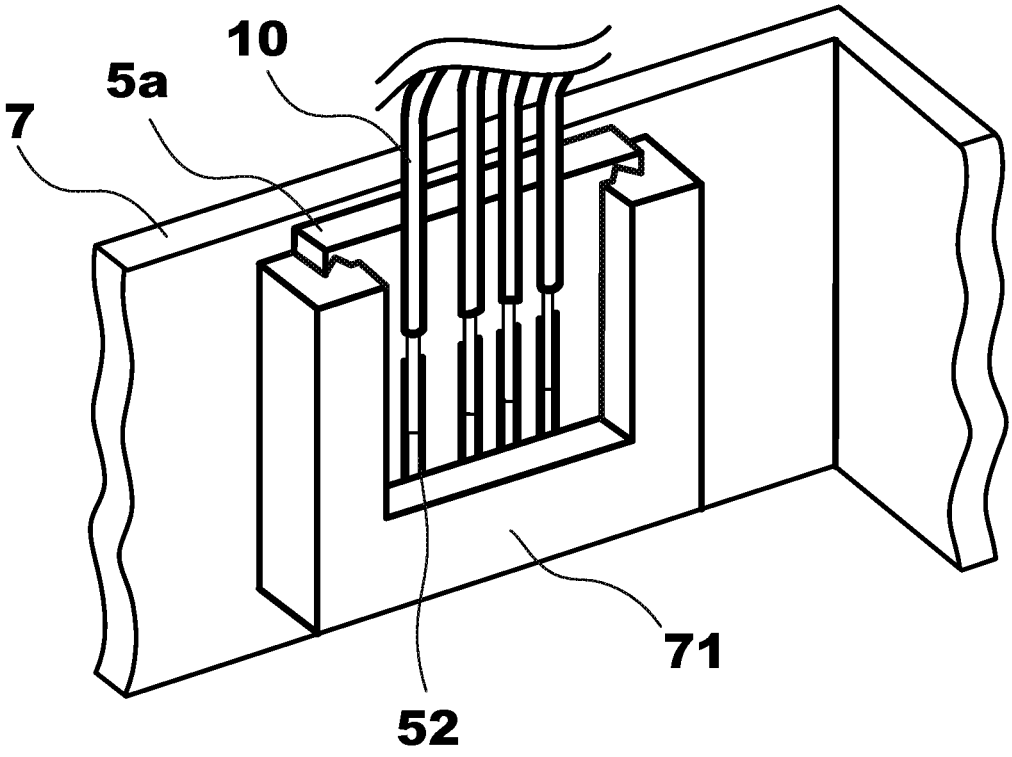
FIG. 3 illustrates a case pocket structured on inside wall of the lower case, into which the I/F board inserted.

The main board 3*a* is disposed in a lower case 7. In this regard, the I/F board 5*a* is inserted into a case pocket 71 (one example of a holding mechanism) provided at the side wall of the lower case 7 as illustrated in FIG. 3. In this embodiment, the case pocket 71 and the lower case 7 are casted as one body.

As illustrated in FIG. 2, a pocket ribs 72 are provided at two places on the inner side of the case pocket 71. When the I/F board 5*a* is inserted into the case pocket 71, the I/F board 5*a* is pressed against the inner wall of the lower case 7 due to the force from the pocket ribs 72, thereby sticking tightly so that there is substantially no gap between the I/F board 5*a* and the inner wall of the lower case 7.

Further, openings 73 are structured on the inner wall of the lower case 7 within the case pocket 71. The openings 73 are facing to the electrode pads 51 provided on the A surface of the I/F board 5*a* (refer to C Portion enlarged figure).

After the main board 3*a* is placed in the lower case 7, resin (filler or filling agent) is poured into the lower case assembly, although it is not illustrated in FIG. 2. After that, an upper case 6 is put on the lower case assembly so that an inner portion of the lower case 7 is covered.

Figure 4:
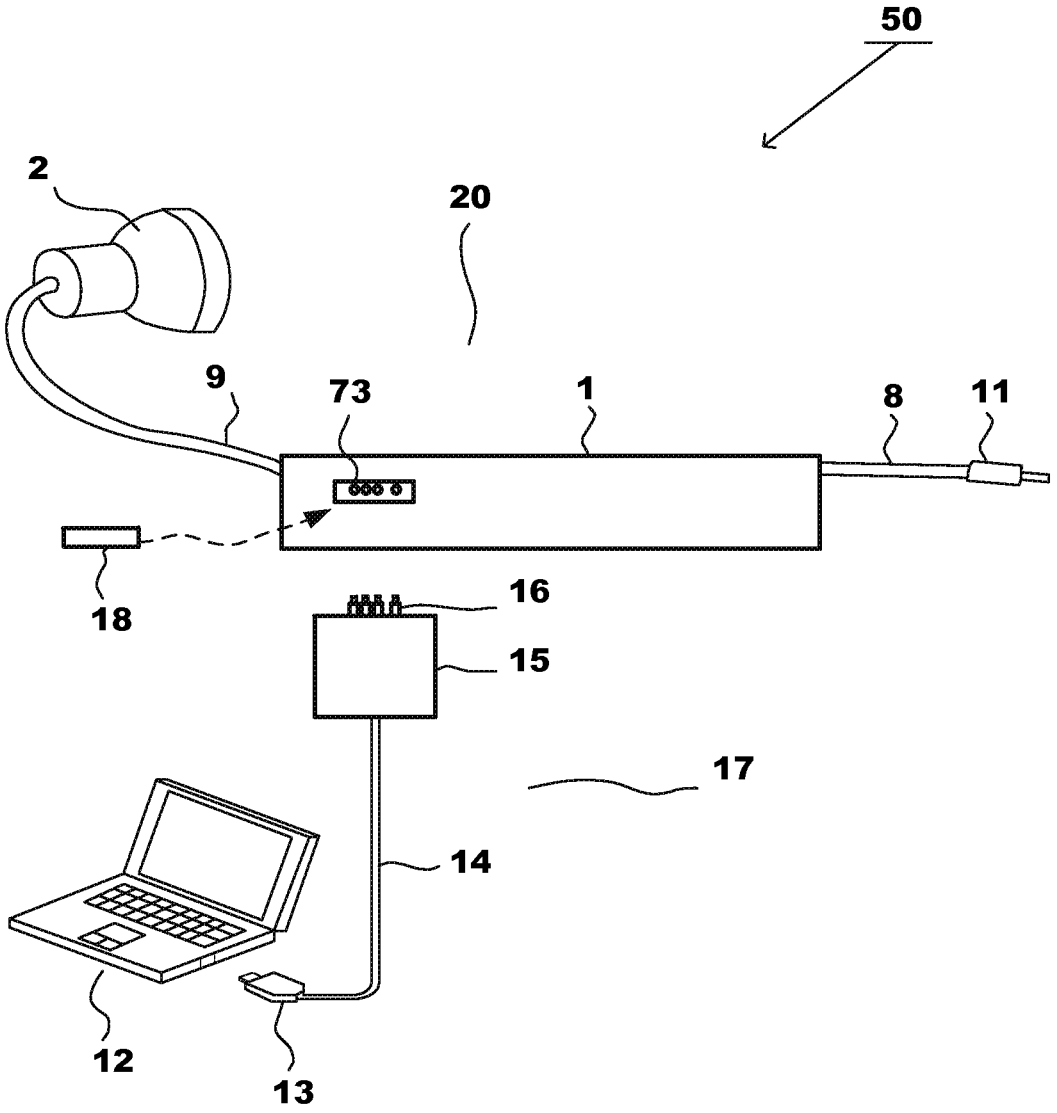
FIG. 4 illustrates an LED lighting system containing the power supply device, the LED module, a data writer and a personal computer, which transmits control parameters to the memory inside the power supply device through the data writer due to the change of the specification of the LED module.

FIG. 4 illustrates an LED illumination device 20 which includes the power supply device 1, and a power supply system 50 which includes the LED illumination device 20.

As illustrated in FIG. 4, the LED illumination device 20 is comprised of the power supply device 1, a power supply plug 11 which is connected to the input cords 8 and an LED module 2 which is connected to the output cords 9. Further, the LED illumination device 20 is comprised of a sticker 18 (one example of a sealing material) which closes the openings 73 of the lower case 7 except when the control parameter is being written.

The power supply device system 50 is comprised of the LED illumination device 20, a personal computer 12 and a data writing unit 17. The data writing unit 17 is comprised of a USB connector 13 which is inserted into a data output terminal of the personal computer 12, a writer 15 for writing the control parameter to the power supply device 1 and a cable 14 which connects the USB connector 13 with the writer 15. The writer 15 has a plurality of (four in FIG. 4) probe pins 16 to output the control parameter (for example, RS232C serial data terminal).

Figure 5:
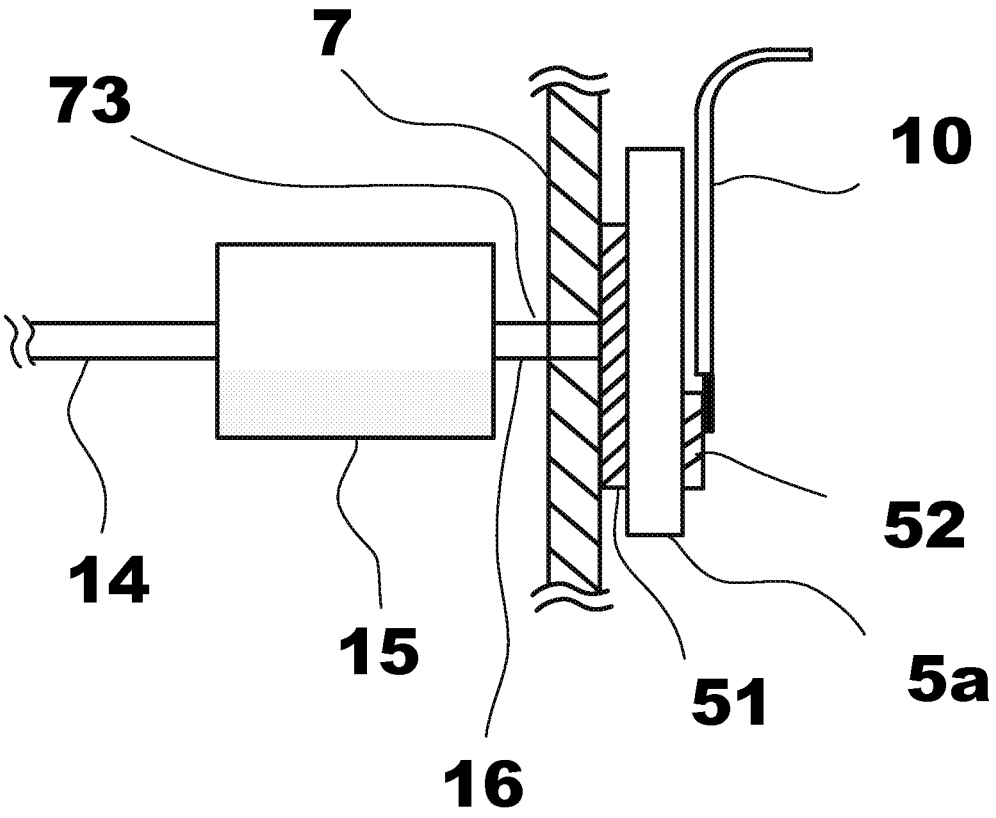
FIG. 5 illustrates a cross sectional view of the portion which illustrates the contact structure between the probe pin of the data writer passing through opening structured the lower case of the power supply device and the electrode on the I/F board.

FIG. 5 illustrates a partial cross-sectional view which illustrates a state where data is being received through the I/F board 5*a*.

As illustrated in FIG. 5, the probe pins 16 of the writer 15 are inserted into the openings 73 of the lower case 7. The probe pins 16 contact to the electrode pads 51 formed on the A surface of the I/F board 5*a*. Then, the control parameter output from the personal computer 12 (not shown in the figures) is transmitted into the microcontroller 41 mounted on the daughter board 4*a* via the I/F board 5*a*. The openings 73 has a size being substantially equal to a diameter of the probe pin 16 so that the probe pins 16 can be inserted with substantially no tolerance.

Figure 9:
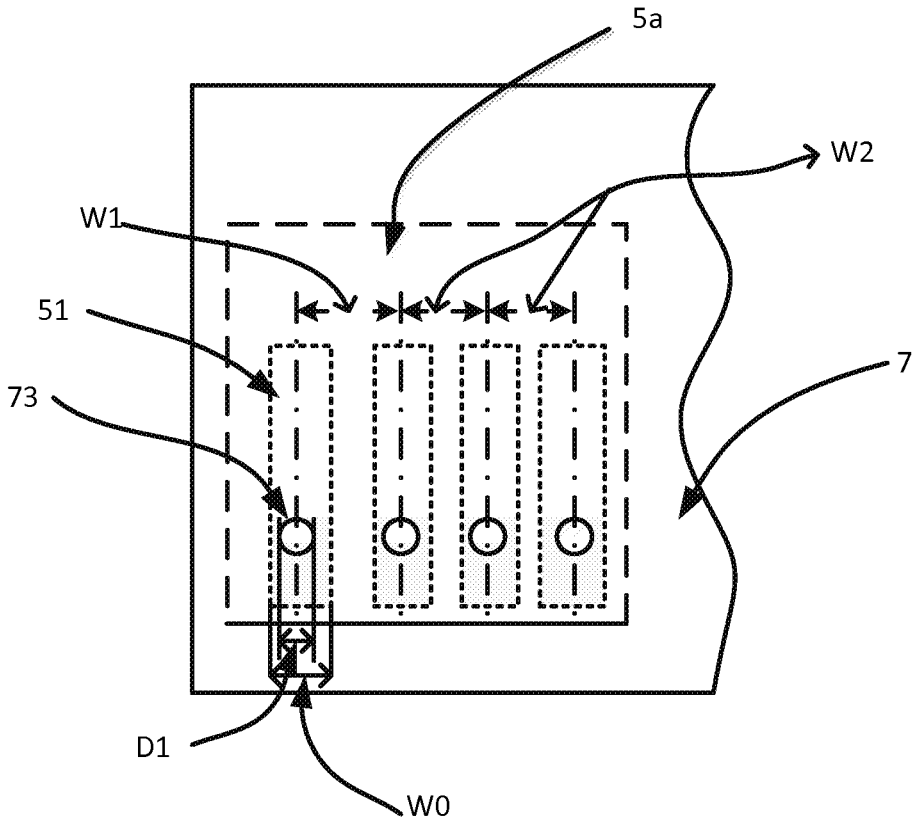
FIG. 9 illustrates a circular opening formed with the lower case having diameter D1, an electrode pad having width of W0 provided on the A surface of the I/F board and the relationship between distances W1 and W2 being distances of each electrode pad(s).

FIG. 9 illustrates the openings 73 formed with the lower case 7 having diameter D1, the electrode pads 51 having width of W0 provided on the A surface of I/F board 5*a* and the relationship between distances W1 and W2 being distances of each electrode pads 51.

The diameter D1 of the openings 73 is selected so that the diameter D1 is substantially equal to or less than the width W0 of the electrode pads 51. Since the probe pins 16 of the writer 15 is inserted through the openings 73 of the lower case 7, the probe pins 16 of the writer 15 can firmly contact the electrode pads 51.

Further, in the embodiment illustrated in FIG. 9, the center distance between the electrode pads 51 located in the most left side and the second electrode pad from the most left side opening is W1, and the center distance between three openings 73 positioned in the right side of the I/F board 5*a* is W2 respectively.

The reverse insertion of the probe pins 16 cannot be performed by arranging the electrode pads 51 on the I/F board 5*a* in an asymmetric shape against the center-line of those openings 73 in the left-and-right direction as illustrated in FIG. 9.

According to this asymmetrical arrangement of the electrode pads 51 on the I/F board 5*a*, the electric circuit of the writer 15 and/or a power supply device 1 may be protected from electric destruction caused by the reverse insertion of the probe pins 16.

FIG. 9 illustrates the arrangement of the electrode pads 51, and the asymmetrical arrangement in the left and right direction or horizontal direction of the openings 73 formed with the lower case 7. However, it is not limited to this. For example, it is also possible to provide the openings 73 formed with the lower case 7, each diameter of the openings 73 having different diameter from each other according to the different diameters of the probe pins 16 so that the reverse insertion of probe pins 16 is prevented.

Figure 6:
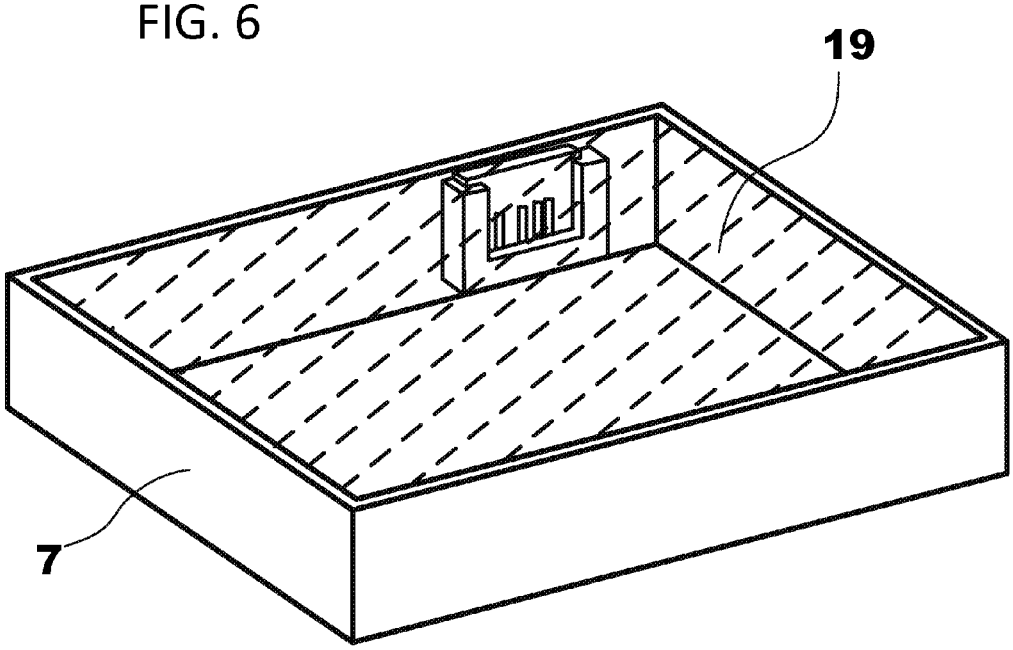
FIG. 6 illustrates the lower case filled with filling agent such as resin or the same type of material.
Figure 7:
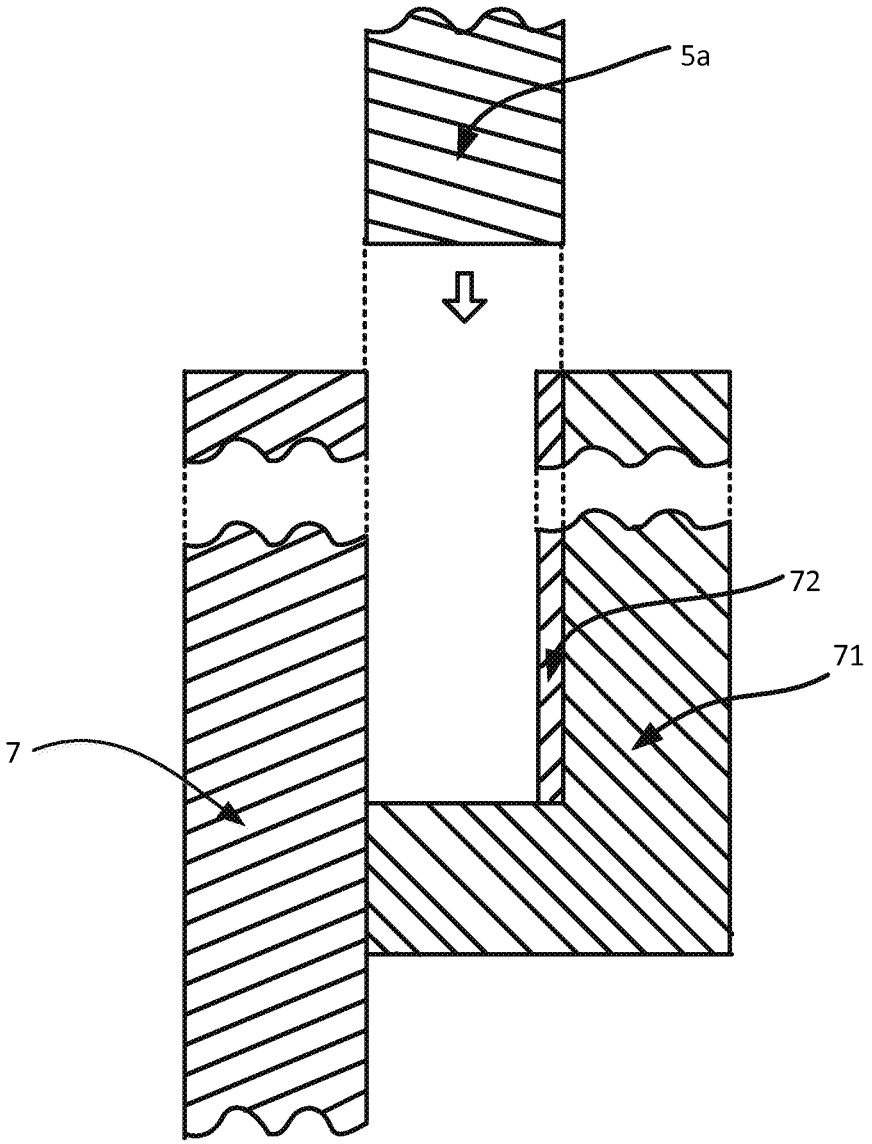
FIG. 7 illustrates a sectional view of the case pocket provided on the inside wall of the case and a pocket rib seen from the side of the cross-section along the cut line A-A' illustrated in FIG. 2.
Figure 8:
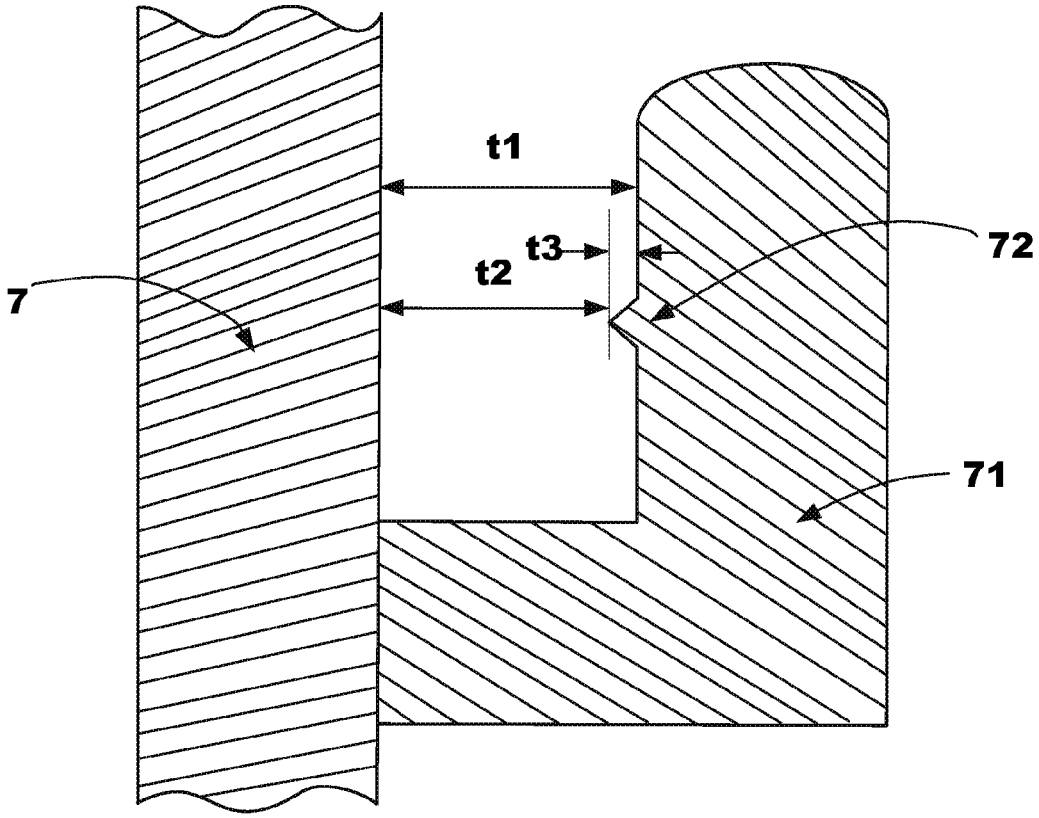
FIG. 8 illustrates a sectional view of the case pocket and the pocket rib which are seen from the side of the cross-section along the cut line B-B' illustrated in FIG. 2.

FIG. 6 illustrates a state where the lower case 7 is filled with filler 19. In this embodiment, as illustrated in FIG. 6, the inside of the case is filled with the filler 19 (for example: resin, etc.) so that the power supply device 1 fulfills certain standards for dust protection and water proof.

After the lower case 7 is filled with the filler 19, the upper case 6 is put on and the inside of the case is sealed off. Thus, it is possible to reduce the invasion of dust and rain due to the device.

For this reason, this embodiment is effective applying to the power supply derive for supplying power to the outdoor LED lighting (streetlight etc.) where dust, wind and raindrops are anticipated. In addition, this embodiment is designed by referring IP66 being International standard for Ingress Protection.

By embedding an interface circuit including no active electrical component on the I/F board 5*a*, which is separated from the main board 3*a* containing the power supply unit 3 and the control unit onto which other electrical circuits for controlling the power output of the power supply device 1 are installed, it becomes possible to make the I/F board 5*a* in a compact sized structure. Accordingly, the degree of freedom of selection of the position of I/F board 5*a* in the power supply device 1 can be increased. Thus, it becomes possible to relatively freely select the position of the I/F board 5*a* with in the enclosure of the power supply device 1. As a result, the power supply device 1 which is optimized to the application can be designed with relatively low design hurdles. Further, comparing with the prior arts, it becomes possible to design the power supply device 1 having an I/F board 5*a* for receiving control information from external devices with a simple and less expensive configuration, which solves the drawbacks associated with prior art.

Since the I/F board 5*a* is a dedicated board for interfacing of control parameters and physically separated from other boards (the main board 3*a* and the daughter board 4*a*) on which other circuits are mounted, it is possible to freely install the I/F board 5*a* at a desired position within the lower case 7.

In addition, since any electronic component is not installed on the I/F board 5*a*, and since the I/F board 5*a* is pressed against the inner wall of the lower case 7 by the pocket ribs 72 provided at the case pocket 71, it is possible to tightly contact the I/F board 5*a* onto the inner side of the lower case 7. Accordingly, it is possible to easily receive the control parameter from outside.

Further, as described above, since the I/F board 5*a* can be tightly contacted on the inner side of the case, the filler 19 does not reach the electrode pads 51 of the A surface. Hence, it is possible to easily materialize a dust protection and water proof specification.

Further, the configuration to receive the control parameters from external devices is inbuilt inside the case, and the control parameter is transmitted through the openings 73 having approximately the same size as that of the probe pins 16.

In addition, the openings 73 is covered with the sticker 18 (one example of a sealing material) except when the control parameter is being transmitted. Therefore, the degree of airtightness is high, and reliability as a method for receiving control parameter is also high.

Further, since the diameter of the openings 73 structured in the side wall of the lower case 7 and the diameter of the probe pins 16 are substantially equal to each other, there is no instability between the probe pins 16 and the openings 73. Thus, the electrical contact of the probe pins 16 to the electrode pads 51 can be surely established. In addition, since it is difficult for any foreign materials such as rubbish etc. to enter inside the case, the contact between the probe pins 16 and the electrode pads 51 is highly reliable.

In this embodiment, the control parameters are transmitted from outside devices to the power supply device 1. However, it is also possible to transmit the control parameter stored inside the microcontroller 41 to the outside devices such as the personal computer 12 electrically connected via the I/F board 5*a*.

In this embodiment, the daughter board 4*a* is configured as a separate board from the main board 3*a*. However, it is also possible to embed the circuit on the daughter board 4*a* on the main board 3*a*.

In this embodiment, the LED module 2 is used as an example of the load of the power supply device 1. However, the load is not limited to the LED module 2. For example, any load, such as electric light bulbs or resisters may be used as the load of the power supply device 1.

The configuration of the power supply unit 3 and the control circuit unit 4 are not restricted to the embodiment illustrated in the FIG. 1. As long as the functions of the power supply device 1 is maintained, any type of configuration of the power supply unit 3 and the control circuit unit 4 may be applicable.

In this embodiment, the methods to connect with the daughter board 4*a* and the I/F board 5*a*, are not limited to the lead wires. FPC (Flexible Printed Circuit), etc. may be utilized instead of lead wires.

The case pocket 71 to hold the I/F board 5*a* does not necessarily need to be formed with the lower case 7 as one body. It may be a separately formed. The case pocket 71 may be a physically separated structure from the lower case 7, which may be attached to the lower case 7.

The position of the I/F board 5*a* does not necessarily need to be the position indicated in FIG. 2. For example, it may be the side wall at the side of the daughter board 4*a*.

Further, the position of the I/F board 5*a* does not necessarily need to be at the side wall of the lower case 7. The position of the I/F board 5*a* may be inside wall of the upper case 6 or even bottom side wall of the lower case 7.

What is claimed is:

1. A power supply device comprising:

a first board;

a second board comprising an electrode pad and no electronic component;

an enclosure into which the first board and the second board are installed;

a power supply unit which supplies power to an external load;

a control circuit unit for controlling output current and/or output voltage from the power supply unit to the external load, the control circuit unit being embedded on the first board;

a memory which stores control information, the memory being utilized in the control circuit unit for controlling the output current and/or the output voltage from the power supply unit;

an interface unit which is capable of receiving the control information from an external device and transmitting the control information to the memory, the interface unit being embedded on the second board which is physically separated from the first board; and a holding structure provided on an inner surface of the enclosure so that the second board is inserted therein, the holding structure comprising a convex structure for fixing the second board to the inner surface of the enclosure, wherein:

the second board is installed at an inner surface at a certain position of the enclosure, the interface unit is capable of receiving the control information from the external device through an opening provided at the certain position of the enclosure, the electrode pad faces the opening provided at the certain position of the enclosure, and the control information is transmitted via a probe pin of the external device contacting the electrode pad through the opening.

2. The power supply device of claim 1, wherein the diameter of the opening is substantially equal to or narrower than the width of the electrode pad.

3. The power supply device of claim 1, wherein the second board is attached at an inner surface at a certain position of the enclosure, and wherein the interface unit is capable of receiving the control information from the external device through a plurality of openings provided at the certain position of the enclosure of the power supply device, the plurality of openings being disposed asymmetrically against a center-line between two end openings of the plurality of openings provided at the certain position of the enclosure.

4. The power supply device of claim 1, further comprising:

a sealing material attached on an outer surface of the enclosure.

5. The power supply device of claim 1, further comprising:

a filling material which fills inside of the enclosure.

6. An LED lighting system comprising:

an LED; and, a power supply device for supplying power to the LED, the power supply device containing a case within which a main board and an interface board are provided;

a power supply unit for supplying power to the LED;

a control unit for controlling the power to the LED by using control information stored in a memory installed in the control unit;

the main board containing the power supply unit and the control unit;

the interface board for receiving the control information generated by an external computer and transmitting the control information to the memory, the interface board being positioned differently from a position of the main board and the interface board having no electronic component;

a holding structure provided on an inner surface of the case so that the interface board is inserted therein; and a convex structure provided at the holding structure for fixing the second board to the inner surface of the case.

7. The LED lighting system of claim 6, further comprising:

a case within which the main board and the interface board are provided, wherein the interface board is capable of receiving the control information from a writer through an opening provided at a certain position of the case.

8. The LED lighting system of claim 7, the interface board further comprising:

an electrode pad which faces the opening provided at the certain position of the case, wherein the control information is transmitted via a probe pin of the writer, the probe pin being contacted to the electrode pad through the opening.

9. The LED lighting system of claim 8, wherein the diameter of the opening is substantially equal to or narrower than the width of the electrode pad.

10. The LED lighting system of claim 6, further comprising:

a case within which the main board and the interface board are provided, wherein the interface board is attached at an inner surface at a certain position of the case, and wherein the interface board is capable of receiving the control information from a writer through a plurality of openings provided at the certain position of the case of the power supply device, the plurality of openings being disposed asymmetrically against a center-line between two end openings of the plurality of openings provided at the certain position of the case.

11. The LED lighting system of claim 7, further comprising:

a holding structure provided on an inner surface of the case so that the interface board is inserted therein.

12. The LED lighting system of claim 7, further comprising:

a sealing material being attached on an outer surface of the case at a position corresponding to the certain position of the case where the opening is provided.

* * * * *